US007514138B2

(12) United States Patent
Ariga et al.

(10) Patent No.: US 7,514,138 B2
(45) Date of Patent: Apr. 7, 2009

(54) HYDRAULIC TRANSFER FILM AND METHOD FOR PRODUCING HYDRAULIC TRANSFER BODY USING THE SAME

(75) Inventors: Toshirou Ariga, Chiba (JP); Yoshitomo Nagata, Sakura (JP); Shuzo Mizuno, Tokyo (JP); Shinji Katoh, Sagamihara (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 541 days.

(21) Appl. No.: 10/518,375

(22) PCT Filed: Jun. 27, 2003

(86) PCT No.: PCT/JP03/08233

§ 371 (c)(1),
(2), (4) Date: Sep. 9, 2005

(87) PCT Pub. No.: WO2004/002752

PCT Pub. Date: Jan. 8, 2004

(65) Prior Publication Data

US 2006/0073342 A1 Apr. 6, 2006

(30) Foreign Application Priority Data

Jul. 1, 2002 (JP) ..... 2002-191992

(51) Int. Cl.

| | |
|---|---|
| ***B41M 5/00*** | (2006.01) |
| ***B41M 3/12*** | (2006.01) |
| ***B44C 1/17*** | (2006.01) |
| ***G03G 7/00*** | (2006.01) |
| ***B05D 1/18*** | (2006.01) |

(52) U.S. Cl. ..... 428/195.1; 428/914; 427/146; 427/147; 427/149; 427/434.3; 427/435

(58) Field of Classification Search ..... 428/195.1, 428/914; 427/146, 147, 149, 434.3, 435
See application file for complete search history.

(56) References Cited

U.S. PATENT DOCUMENTS

| | | | | |
|---|---|---|---|---|
| 4,337,289 | A * | 6/1982 | Reed et al. | 428/211.1 |
| 6,309,734 | B1 * | 10/2001 | Taniguchi et al. | 428/195.1 |
| 6,902,642 | B2 * | 6/2005 | Kawaharada et al. | 156/239 |

FOREIGN PATENT DOCUMENTS

| | | |
|---|---|---|
| JP | 53-74906 | 7/1978 |
| JP | 64-22378 | 1/1989 |
| JP | 1-85100 | 6/1989 |
| JP | 9-76649 | 3/1997 |
| JP | 9-164800 | 6/1997 |
| JP | 2001-277789 | 10/2001 |
| JP | 2001-287268 | 10/2001 |

* cited by examiner

*Primary Examiner*—Callie E Shosho
*Assistant Examiner*—David J Joy
(74) *Attorney, Agent, or Firm*—Edwards Angell Palmer & Dodge LLP

(57) ABSTRACT

An object of the present invention is to provide a hydraulic transfer film with a transfer layer capable of forming a cured resin layer on a hydraulic transfer body, to provide a hydraulic transfer film capable of forming a clear decorative layer on a curable resin layer, and a hydraulic transfer body having excellent surface properties and a clear pattern. A hydraulic transfer film having a water-soluble substrate film, a hydrophobic transfer layer including a curable resin layer which can be cured by at least one of irradiation with radiation and heating provided on the substrate film, and a peelable film provided on the transfer layer is described along with a method for producing the hydraulic transfer film.

8 Claims, No Drawings

HYDRAULIC TRANSFER FILM AND METHOD FOR PRODUCING HYDRAULIC TRANSFER BODY USING THE SAME

TECHNICAL FIELD

The present invention relates to a hydraulic transfer film having a curable resin layer and a method for producing the hydraulic transfer film, and to a method for producing a hydraulic transfer body having a cured resin layer, or the cured resin layer and a decorative layer, using the hydraulic transfer film.

BACKGROUND ART

A hydraulic transfer method is a method which can form a decorative layer having excellent design properties on a formed article having a complicated three-dimensional shape, and it is necessary to form a protective layer made of a curable resin on the hydraulically transferred decorative layer by spray coating after hydraulic transfer. Therefore, the process for the production of a formed article by the hydraulic transfer method is complicated and coating equipment is required in addition to hydraulic transfer equipment. Thus, a formed article produced by the hydraulic transfer method is limited to a specialty product because of high cost.

To solve problems such as complicated processes and high cost, tests for transferring a curable resin layer onto a body to be transferred have been made using the hydraulic transfer method. For example, Japanese Patent Application, First Publication No. Sho 64-22378 (Japanese Patent Application, Second Publication No. Hei 7-29084) discloses a hydraulic transfer sheet having a resin coating layer which is cured by irradiation with ionizing radiation or heat, and a method for producing a formed article having a cured resin layer, which has transferring a coating layer onto a body to be transferred using the hydraulic transfer sheet and then curing the coating layer by ionizing radiation or heat.

However, the hydraulic transfer film described in the above publication had a problem in that the resin used in the curable resin layer is limited. Also, there was a problem in that, when the resulting hydraulic transfer film having a curable resin layer free from tackiness adhesion at room temperature is stored for a long time in a rolled state, blocking occurs between the curable resin layer and the substrate film, or between the decorative layer and the substrate film.

DISCLOSURE OF THE INVENTION

An object of the present invention is to provide a hydraulic transfer film which has a transfer layer capable of forming a cured resin layer having excellent surface properties on a hydraulic transfer body and is less likely to cause blocking.

Another object of the present invention is to provide a method for producing a hydraulic transfer film capable of transferring a cured resin layer and a clear decorative layer onto a body to be transferred.

Still another object of the present invention is to provide a method for producing a hydraulic transfer body having a cured resin layer free from surface defects due to poor transfer of a transfer layer.

The present inventors have intensively studied so as to achieve the above objects and thus the following findings were obtained.

(1) The occurrence of blocking during storage can be prevented by providing a peelable film on a curable resin layer of a hydraulic transfer film having a curable resin layer.

(2) By forming a curable resin layer and a decorative layer on a substrate film and a peelable film, respectively, and laminating both films by dry lamination, a clear pattern can be formed on the curable resin layer.

(3) Since the hydraulic transfer film is excellent in film feeding properties and is less likely to cause poor transfer even after being stored for a long time while rolled, a hydraulic transfer body having a cured resin layer with excellent surface properties and a clear pattern can be produced.

The present invention has been completed based on the above findings.

The present invention provides a hydraulic transfer film and the hydraulic transfer film has a substrate film made of a water-soluble or water-swellable resin, a hydrophobic transfer layer which is soluble in an organic solvent provided on the substrate film, the transfer layer having a curable resin layer which can be cured by at least one of irradiation with radiation and heating, and a peelable film provided on the transfer layer which can be peeled off at the interface with the transfer layer.

Also the present invention has a method for producing a hydraulic transfer film, and the method comprises laying a film (I) comprising a hydrophobic curable resin layer which is curable by at least one of irradiation with radiation and heating and is soluble in an organic solvent provided on the substrate film containing a water-soluble or water-swellable, and a film (II) comprising a hydrophobic decorative layer made of a printing ink film or a coating film which is soluble in an organic solvent provided on the peelable film one upon another so that the curable resin layer of the film (I) and the decorative layer of the film (II) face each other, and laminating them by dry lamination.

Also, the present invention provides a method for producing a hydraulic transfer body and the method has steps of peeling the peelable film from the above hydraulic transfer film, followed by floating the hydraulic transfer film on the water surface so that the substrate film faces downward, activating the transfer layer with an organic solvent, transferring the transfer layer onto the body to be transferred, removing the substrate film, and curing the transfer layer by at least one of irradiation with radiation and heating.

BEST MODE FOR CARRYING OUT THE INVENTION

The substrate film containing a water-soluble or water-swellable resin used in the hydraulic transfer film of the present invention is a film containing a resin which is soluble or swellable in water.

As the substrate film containing a water-soluble or water-swellable resin (hereinafter abbreviated to a substrate film), for example, there can be used films made of PVA (polyvinyl alcohol), polyvinyl pyrrolidone, acetyl cellulose, polyacrylamide, acetylbutyl cellulose, gelatine, glue, sodium alginate, hydroxyethyl cellulose and carboxymethyl cellulose. Among these films, a PVA film used generally as a hydraulic transfer film is particularly preferable because it is easily soluble in water, is easily available, and is also suitable for printing of a curable resin layer. The thickness of the substrate film is preferably from about 10 to 200 μm.

The transfer layer to be provided on the substrate film of the hydraulic transfer film of the present invention will now be described. The transfer layer is a hydrophobic layer which is soluble in an organic solvent. The organic solvent is the same as an activating agent used for conventional hydraulic transfer. As the transfer layer, for example, there can be used a hydrophobic layer which is soluble in toluene, xylene, butyl cellosolve, butylcarbitol acetate, carbitol, carbitol acetate, cellosolve acetate, methyl isobutyl ketone, ethyl acetate, isobutyl acetate, isobutyl alcohol, isopropyl alcohol, n-butanol or solfit acetate (3-methoxy-3-methyl-1-butylacetate), or a mixture thereof.

The transfer layer is transparent and has a curable resin layer which can be cured by at least one of irradiation with radiation and heating (hereinafter abbreviated to a curable resin layer). The transfer layer may have a decorative layer made of a printing ink film or a coating film (hereinafter abbreviated to a decorative layer) provided on the curable resin layer, in addition to the curable resin layer.

To achieve good design properties of the decorative layer of the resulting hydraulic transfer body, the curable resin layer is preferably transparent. Although it depends on the required properties of the hydraulic transfer body, basically the curable resin layer may be sufficiently transparent to see a color or pattern of the decorative layer of the hydraulic transfer body through it and does not need to be completely transparent, and it may be transparent or semi-transparent. Also, it may be colored.

The curable resin layer contains a resin which can be cured by at least one of irradiation with radiation and heating, and specific examples thereof include the following curable resin layers (1) to (6):

(1) a curable resin layer containing a radiation-curable resin, (2) a curable resin layer containing a radiation-curable resin and a non-polymerizable thermoplastic resin, (3) a curable resin layer containing a thermosetting resin, (4) a curable resin layer containing a thermosetting resin and a non-polymerizable thermoplastic resin, (5) a curable resin layer containing a radiation-curable resin and a thermosetting resin, and (6) a curable resin layer containing a radiation-curable resin, a thermosetting resin and a non-polymerizable thermoplastic resin.

Since the hydraulic transfer film of the present invention is produced by laminating a substrate film on which a curable resin layer is provided by coating or printing with a peelable film, or laminating a substrate film on which a curable resin layer is provided by coating or printing with a peelable film on which a decorative layer is provided by coating or printing using a dry lamination method, the curable resin layer is preferably free from adhesion at room temperature in view of operability such as properties of feeding from a roll on dry lamination, and less occurrence of blocking during storage of the film.

Since the substrate film including PVA film has poor heat resistance and shrinking or wrinkling on lamination of the film may occur when laminated at a temperature higher than 120° C., a adhesion initiation temperature of the curable resin layer is preferably 40° C. or higher and 120° C. or lower, and more preferably from 40 to 100° C.

The adhesion initiation temperature as used herein refers to a minimum temperature defined in the following manner. That is, a film obtained by applying a resin on a 100 μm thick PET film in a thickness (on the basis of solid content) of 10 μm using a bar coater was dried at 70° C. for 10 minutes to thereby vaporize the solvent and, after cooling to room temperature, the film was put in a hot-air drier and the temperature was raised from room temperature by 5° C. Then, adhesion was tested by touching with the fingers at each temperature to determine the minimum temperature at which fingerprints remained.

The specific constituent features (1) to (6) of the curable resin layer will now be described.

(1) Curable Resin Layer Containing a Radiation-Curable Resin

The radiation-curable resin includes an oligomer and a polymer, each having a polymerizable group or structural unit, which can be cured by radiation, in a molecule. The radiation as used herein refers to ultraviolet light and electron beams. There can be used the oligomer and polymer which are cured by the radiation, and an ultraviolet-curable resin is particularly preferable.

As the ultraviolet light source, for example, there can be used a low pressure mercury vapor lamp, a high pressure mercury vapor lamp, an ultrahigh pressure mercury vapor lamp, a carbon arc lamp, a metal halide lamp, and a xenon lamp.

Examples of the polymerizable group or structural unit, which can be cured by radiation, include groups or structural units, each having a polymerizable unsaturated double bond such as (meth)acryloyl group, styryl group, vinyl ester, vinyl ether, maleimide group or the like. Among these, (meth) acryloyl group is preferable. Among these, a radiation-curable oligomer or polymer having at least three (meth)acryloyl groups in a molecule is preferable. More specifically, it is preferred to use a radiation-curable oligomer or polymer having at least three (meth)acryloyl groups in a molecule and having a mass-average molecular weight of 300 to 10,000, and more preferably 300 to 5,000.

The oligomer or polymer having a (meth)acryloyl group can be used without causing any problem as long as it is used as a resin for coating compositions. Specific examples thereof include polyurethane (meth)acrylate, polyester (meth)acrylate, polyacryl (meth)acrylate, epoxy (meth)acrylate, polyalkylene glycol poly (meth)acrylate and polyether (meth) acrylate, and polyurethane (meth)acrylate, polyester (meth) acrylate, and epoxy (meth) acrylate are preferably used.

Particularly, polyurethane (meth)acrylate obtained as a reaction product of polyol, hydroxyl group-containing (meth) acrylate and polyisocyanate is preferable because of excellent surface properties.

Specific examples of the polyol include ethylene diglycol, diethylene glycol, triethylene glycol, polyethylene glycol, polypropylene glycol, dipropylene glycol, 1,2-butanediol, 1,3-butanediol, 1,4-butanediol, polybutylene glycol, 1,3-pentanediol, neopentyl glycol, 1,6-hexanediol, cyclohexanediol, cyclohexanedimethanol, bisphenol A, hydrogenated bisphenol A, ethylene oxide adduct of bisphenol A, propylene oxide adduct of bisphenol A, glycerin and trimethylolpropane.

Specific examples of the hydroxyl group-containing (meth)acrylate include hydroxyalkyl ester having 2 to 8 carbon atoms of acrylic or methacrylic acid, such as 2-hydroxyethyl (meth)acrylate or hydroxybutyl (meth)acrylate; monoester of polyether polyol such as polyethylene glycol or polypropylene glycol and unsaturated carboxylic acid such as acrylic or methacrylic acid; monoether of polyether polyol such as polyethylene glycol and hydroxyl group-containing unsaturated monomer such as 2-hydroxyethyl acrylate; monoester or diester compound of acid anhydride group-containing unsaturated compound such as maleic anhydride or itaconic anhydride and glycols such as ethylene glycol; hydroxyalkyl vinyl ethers such as hydroxyethyl vinyl ether; adduct of α,β-unsaturated carboxylic acid and monoepoxy compound such as α-olefin epoxide; adduct of glycidyl acrylate or glycidyl methacrylate and monobasic acid such as acetic acid, propionic acid, p-tert-butylbenzoic acid or fatty acid; and adduct of the above hydroxyl group-containing monomer and lactones (for example, ε-caprolactone and γ-valerolactone).

The polyisocyanate may be a compound having at least two (divalent) isocyanate groups in a molecule and diisocyanate or a compound having at least three (trivalent) isocyanate groups in a molecule can be used.

Specific examples of the diisocyanate include aliphatic diisocyanates such as hexamethylene diisocyanate, trimethylhexamethylene diisocyanate, dimer acid diisocyanate and lysine diisocyanate; cyclic aliphatic diisocyanates such as hydrogenated xylylene diisocyanate, cyclohexylene diisocyanate and isophorone diisocyanate; and aromatic diisocyanates such as tolylene diisocyanate and naphthalene diisocyanate.

Specific examples of the trivalent or polyvalent polyisocyanate include aliphatic triisocyanate such as 2-isocyanatoethyl-2,6-diisocyanatocaproate or 1,3,5-triisocyanatocyclohexane; aromatic triisocyanate such as 1,3,5-triisocyanatobenzene or 2,4,6-triisocyanatonaphthalene; and polyisocyanates having a so-called isocyanurate ring structure obtained by cyclization and trimerization of diisocyanates.

Specific examples of the trivalent or polyvalent polyisocyanate include dimers or trimers of divalent or polyvalent polyisocyanate, adduct obtained by reacting divalent, trivalent or polyvalent polyisocyanate with polyhydric alcohol, low-molecular polyester resin or water under the conditions of an excess isocyanate group; and polyisocyanates having a biuret structure obtained by reacting polyisocyanates with water.

There can also be used polyurethane (meth)acrylate obtained by reacting a homopolymer of a vinyl monomer having an isocyanate group such as 2-isocyanate ethyl (meth) acrylate, 3-isopropenyl-α,α-dimethylbenzyl isocyanate or (meth)acryloyl isocyanate, or an isocyanate group-containing vinyl copolymer obtained by copolymerizing the isocyanate group-containing vinyl monomer with (meth)acryl, vinyl ester, vinyl ether, aromatic vinyl or fluoroolefin vinyl monomers, which are copolymerizable with the monomer, with the hydroxyl group-containing (meth)acrylate.

It is particularly preferable to use, as a radiation-curable resin, an ultraviolet-curable polyurethane (meth)acrylate having at least three (meth)acryloyl groups in a molecule and having a mass-average molecular weight of 300 to 10,000, and more preferably 300 to 5,000, thus obtained as described above.

The curable resin layer containing the radiation-curable resin may contain conventional photoinitiators and photosensitizers, if necessary. Typical examples of the photoinitiator include acetophenone compounds such as diethoxyacetophenone and 1-hydroxycyclohexyl-phenyl ketone; benzoin compounds such as benzoin and benzoin isopropyl ether; acylphosphine oxide compounds such as 2,4,6-trimethylbenzoin diphenylphosphine oxide; benzophenone compounds such as methyl-o-benzoylbenzoate and 4-phenylbenzophenone; thioxanthone compounds such as 2,4-dimethylthioxanthone; aminobenzophenone compounds such as 4,4'-diethylaminobenzophenone; and polyether maleimidecarboxylate ester compounds. These compounds can also be used in combination.

The amount of the photoinitiator is usually from 0.1 to 15% by weight, and preferably from 0.5 to 8% by weight, based on the radiation-curable resin. Examples of the photosensitizer include amines such as triethanolamine and ethyl 4-dimethylaminobenzoate. Furthermore, onium salts such as benzylsulfonium salt, benzylpyridinium salt and arylsulfonium salt are known as a photocation initiator and these initiators can also be used. The combination with the above photoinitiators can be used.

(2) Curable Resin Layer Containing Radiation-Curable Resin and Non-Polymerizable Thermoplastic Resin The curable resin layer containing a radiation-curable resin and a non-polymerizable thermoplastic resin contains the above radiation-curable resin and non-polymerizable thermoplastic resin. The use of the non-polymerizable thermoplastic resin in combination with the radiation-curable resin is extremely effective to reduce adhesion of the curable resin layer and to improve a glass transition temperature (Tg) and a cohesive failure strength of the curable resin layer. When the amount of the thermoplastic resin in the curable resin layer is large, the curing reaction of the curable resin is inhibited, and therefore the thermoplastic resin is preferably added in the amount of less than 70 parts by weight based on 100 parts by weight of the total amount of the resin in the curable resin.

The non-polymerizable thermoplastic resin is compatible with the radiation-curable resin, and specific examples thereof include polymethacrylate, polystyrene, polyvinyl chloride, polyvinylidene chloride, polyvinyl acetate and polyester. These resins may be a homopolymer, or a copolymer obtained by copolymerizing plural monomers.

Among these, polystyrene and polymethacrylate are preferable because they have high Tg and are suited for reducing adhesion of the curable resin layer, and polymethacrylate containing polymethylmethacrylate as a main component is particularly preferable because of excellent transparency, solvent resistance and rubbing resistance.

The molecular weight of Tg of the thermoplastic resin exert a large influence on the coating film forming capability. To inhibit fluidity of the curable resin and to facilitate activation of the curable resin layer due to the organic solvent, the mass-average molecular weight of the thermoplastic resin is preferably from 3,000 to 400,000, and more preferably from 10,000 to 200,000, while Tg is preferably from 35 to 200° C., and more preferably from 35 to 150° C. When using a thermoplastic resin having comparatively low Tg of about 35° C., the mass-average molecular weight of the thermoplastic resin is preferably 100,000 or more.

The curable resin layer containing a radiation-curable resin and a non-polymerizable thermoplastic resin is particularly preferably a curable resin layer containing a radiation-curable resin having at least three (meth)acryloyl groups in a molecule and having a mass-average molecular weight of 300 to 10,000, preferably 300 to 5,000, and a non-polymerizable thermoplastic resin, which is compatible with the radiation-curable resin, having Tg of 35 to 200° C., more preferably 35 to 150° C. and having a mass-average molecular weight of 3,000 to 400,000, preferably 10,000 to 200,000. Particularly preferred is a curable resin layer wherein the radiation-curable resin is polyurethane (meth)acrylate having at least three (meth)acryloyl groups in a molecule and the non-polymerizable thermoplastic resin is polymethacrylate, preferably polymethylmethacrylate.

(3) Curable Resin Layer Containing Thermosetting Resin

The thermosetting resin is a compound having a functional group in the molecule capable of polymerizing by an action of heat or a catalyst, or obtained by mixing a thermosetting compound as a base agent with a thermoreactive compound as curing agent. Examples of the functional group capable of polymerizing by an action of heat or a catalyst include N-methylol group, N-alkoxymethyl group, epoxy group, methylol group, acid anhydride and carbon-carbon double bond.

When the curable resin layer has a carbon-carbon double bond in the molecule and can cause the crosslinking reaction by polymerization, for example, a curable resin which is the same as the radiation-curable resin can be used. A combination of the curable resin and a thermal polymerization initiator capable of generating a radical source under heating can be used as a thermosetting resin. In this case, a conventional thermal polymerization initiator such as benzoyl peroxide or azobisisobutyronitrile can be used as the thermal polymerization initiator.

Specific examples of the combination of a base agent and a curing agent can be a combination of a resin having a hydroxyl group or an amino group as a base agent and isocyanate as a curing agent; combination of a resin having a hydroxyl group or a carboxyl group as a base agent and an amino resin such as N-methylolated or N-alkoxymethylated melamine or benzoguanamine as a curing agent; combination of a resin having an epoxy group or a hydroxyl group as a base agent and an acid anhydride such as phthalic anhydride as a curing agent; combination of a resin having a carboxyl group, a carbon-carbon double bond, a nitrile group or an epoxy group as a base agent and a phenol resin as a curing agent; and combination of a resin having a carboxyl group or an amino group as a base agent and an epoxy group-containing compound as a curing agent.

In the case of these thermosetting resins, the curing reaction often proceeds gradually during storage even at normal temperature. When the curing reaction proceeds during the storage, the transfer layer is not sufficiently activated by the organic solvent and poor transfer may occur. Therefore, a resin comprising polyol as a base agent and blocked isocyanate as a curing agent is preferable among thermosetting resins.

The blocked isocyanate wherein an isocyanate group is protected with a conventional blocking agent can be used and examples of the conventional blocking agent include phenol, cresol, aromatic secondary amine, tertiary alcohol, lactam and oxime. The blocked isocyanate having a suitable elimination temperature of a block group may be selected according to heat resistance of the decorative layer and heat resistance of the body to be transferred.

Examples of the polyol include acrylpolyol, poly-p-hydroxystyrene, polyester polyol and polyethylene-vinyl alcohol copolymer, and acrylpolyol is preferable. Particularly preferred is acrylpolyol having a mass-average molecular weight of 3,000 to 100,000, more preferably 10,000 to 70,000.

Since the thermosetting resin requires printability or coatability, the resin before curing preferably has a high molecular weight and the mass-average molecular weight is preferably from 1,000 to 100,000, and more preferably from 3,000 to 30,000. More specifically, a resin comprising polyol (particularly preferably acrylpolyol) having a mass-average molecular weight of 3,000 to 100,000, preferably 10,000 to 70,000, as a base agent and blocked isocyanate as a curing agent is preferably used.

(4) Curable Resin Layer Containing Thermosetting Resin and Non-Polymerizable Thermoplastic Resin The curable resin layer containing a thermosetting resin and a non-polymerizable thermoplastic resin contains the thermosetting resin described in (3) and the non-polymerizable thermoplastic resin described in (2).

The thermosetting resin to be used is the same as the thermosetting resin described in (3) and preferable thermosetting resin includes blocked isocyanate and polyol similar to (3). In particular, the polyol is preferably acrylpolyol and has a mass-average molecular weight of 3,000 to 100,000, more preferably 10,000 to 70,000.

When using blocked isocyanate and polyol as the thermosetting resin, the polyol has coating film forming capability and therefore the non-polymerizable thermoplastic resin may be used in a small amount. The non-polymerizable thermoplastic resin must be compatible with the thermosetting resin. When blocked isocyanate and polyol are used as the thermosetting resin, a non-polymerizable thermoplastic resin, which is dissolved in polyol, is preferable. The non-polymerizable thermoplastic resin is preferably a non-polymerizable thermoplastic resin having Tg of 35 to 200° C., preferably 35 to 150° C., and having a mass-average molecular weight of 3,000 to 400,000, preferably polymethacrylate, and particularly preferably polymethyl methacrylate.

(5) Curable Resin Layer Containing Radiation-Curable Resin and Thermosetting Resin As the curable resin layer containing a radiation-curable resin and a thermosetting resin, the radiation-curable resin described in (1) and the thermosetting resin described in (3) can be used. For example, it contains (meth)acrylate having at least three (meth)acryloyl groups in a molecule, blocked isocyanate and polyol.

The curable resin layer preferably contains preferable radiation-curable resin described in (1) and preferable thermosetting resin described in (3), for example, an oligomer or polymer having a mass-average molecular weight of 300 to 10,000, preferably 300 to 5,000, and having at least three (meth)acryloyl groups in a molecule, particularly preferably polyurethane (meth)acrylate, or blocked isocyanate and acrylpolyol having a mass-average molecular weight of 3,000 to 100,000, preferably 10,000 to 70,000.

(6) Curable Resin Layer Containing Radiation-Curable Resin, Thermosetting Resin and Non-Polymerizable Thermoplastic Resin The curable resin layer containing a radiation-curable resin, a thermosetting resin and a non-polymerizable thermoplastic resin is a curable resin layer containing the radiation-curable resin described in (1), the thermosetting resin described in (3), and the non-polymerizable thermoplastic resin described in (2) which is used in combination with the radiation-curable resin.

As the dry thickness of the above curable resin layer increases, larger surface protection effect of the resulting hydraulic transfer body is exerted and larger effect of covering unevenness of the decorative layer is exerted, and thus excellent gloss can be imparted to a formed article, preferably. However, when the dry thickness is too large, activation (solubilization) of the curable resin layer due to the organic solvent may become insufficient. Therefore, the dry thickness of the curable resin layer is preferably from 3 to 200 μm, and more preferably from 10 to 70 μm, so as to sufficiently activate the curable resin layer due to the organic solvent and to satisfy the function suited for use as the protective layer and the effect of covering unevenness of the decorative layer.

The decorative layer will now be described.

The printing ink or coating composition used to form the decorative layer of the present invention is a printing ink or coating composition which can print or apply on a peelable film, and which preferably exhibits low peel force with the peelable film and is activated with the organic solvent to obtain sufficient flexibility when a transfer layer is transferred onto a body to be transferred. In particular, a gravure printing ink is preferable. Also a colored layer with no pattern can also be formed by coating.

Examples of the resin for varnish used in the printing ink or coating composition are preferably thermoplastic resins such as acrylic resin, polyurethane resin, polyamide resin, urea resin, epoxy resin, polyester resin, vinyl resin (vinyl chloride, vinyl acetate copolymer resin), vinylidene resin (vinylidene chloride, vinylidene fluonate), ethylene-vinyl acetate resin, polyolefin resin, chlorinated olefin resin, ethylene-acrylic resin, petroleum resin and cellulose derivative resin.

The colorant in the decorative layer is preferably a pigment, and any of inorganic pigments and organic pigments can be used. There can also be used a metal gloss ink containing a paste of metal cutting particles or metal strips obtained from a deposited metal film as a pigment. As the metal, for example, aluminum, gold, silver, brass, titanium, chromium, nickel, nickel chromium and stainless steel are preferably used. These metal strips may be surface-treated with a cellulose derivative such as epoxy resin, polyurethane, acrylic resin or nitrocellulose so as to improve dispersibility, antioxidation properties and strength of the ink layer (decorative layer).

As the method of forming a decorative layer, offset printing, screen printing, ink-jet printing and heat transfer printing methods can be used, in addition to a gravure printing method. Dry thickness of the decorative layer, ink-jet printing and heat transfer printing methods can be used. The dry thickness of the decorative layer is preferably from 0.5 to 15 μm, and more preferably from 1 to 7 μm.

As long as design properties and spreadability are not inhibited, various conventional additives such as defoamers, sedimentation inhibitors, pigment dispersants, fluidity modifiers, blocking inhibitors, antistatic agents, antioxidants, photostabilizers and ultraviolet absorbers may be added in the curable resin layer and the decorative layer.

The peelable film will now be described.

In the hydraulic transfer film of the present invention, the peelable film must be peeled off from a transfer layer containing a curable resin layer or a curable resin layer and a decorative layer on hydraulic transfer. In that case, the peelable film must be peeled off at the interface of the transfer layer. Therefore, the peelable film used in the hydraulic transfer film preferably exhibits a small peel force at the interface of the transfer layer.

As described above, the hydraulic transfer film of the present invention is produced by laminating a substrate film on which a curable resin layer is provided by coating or printing with a peelable film, or laminating a substrate film on which a curable resin layer is provided by coating or printing with a peelable film on which a decorative layer is provided by coating or printing using a dry lamination method. Therefore, the decorative layer provided on the peelable film by coating or printing must be fixed onto the peelable film with a peel force sufficient to prevent peeling of the decorative layer during operation or handling such as film feeding. Therefore, the peel force of the peelable film at the interface with the transfer layer is measured and preferable combination of the peelable film and the transfer layer is selected.

Because of the need for sufficient peel force to prevent peeling of the decorative layer during operation or handling such as film feeding, the peel force (F1) between the peelable film and the transfer layer, specifically, a peel force measured by a peeling test defined in JIS K6854 is preferably 0.7 g/cm or more. When the peel force (F1) is too large, a striation pattern is formed on the surface of the transfer layer (zipping) when the peelable film is peeled off from the transfer layer, and thus the peel force (F1) is preferably less than 60 g/cm. Therefore, the peel force (F1) between the peelable film and the transfer layer is preferably from 0.7 to 60 g/cm, and more preferably from 3 to 40 g/cm.

As the peelable film, specifically, there can be used films made of polypropylene, polyethylene, polyester, nylon and polyvinyl chloride, and the thickness is preferably from 20 to 250 μm.

The peel force of the peelable film at the interface between the peelable film and the transfer layer may be measured and preferable combination of the peelable film and the transfer layer may be selected. If necessary, the peel force (F1) can also be reduced by subjecting the peelable film to a surface treatment.

The method for producing a hydraulic transfer film of the present invention will now be described.

The method for producing a hydraulic transfer film of the present invention has laying a film (I) a hydrophobic curable resin layer which is curable by at least one of irradiation with radiation and heating and is soluble in an organic solvent provided on the substrate film containing a water-soluble or water-swellable resin, and a film (II) comprising a hydrophobic decorative layer made of a printing ink film or a coating film which is soluble in an organic solvent provided on the peelable film one upon another so that the curable resin layer of the film (I) and the decorative layer of the film (II) face each other, and laminating them by dry lamination.

The hydraulic transfer film of the present invention is preferably produced by using a dry laminater. specifically, a substrate film is mounted in one feed roll (first feed roll) of the dry laminater, and a film (II) wherein a decorative layer with a pattern is previously provided on a peelable film pattern by printing is mounted in the other feed roll (second feed roll). A solution of the above curable resin in an organic solvent is applied on the substrate film fed from the first feed roll and then dried in a drier to form a film (I) wherein a curable resin layer is formed on the substrate film. Then, the film (I) and the film (II) fed from the second feed roll are laid one upon another so that the curable resin layer of the film (I) and the decorative layer of the film (II) face each other, laminated by a heat pressure roll and then taken up by a take-up roll to produce a hydraulic transfer film of the present invention.

The solution of the curable resin in the organic solvent can be applied on the substrate film by using a slit reverse coater, a die coater, a comma coater, a bar coater, a knife coater, a gravure coater, a gravure reverse coater, a microgravure coater, a flexo coater, a blanket coater, a roll coater, an air knife coater or the like.

The film (II) comprising a decorative layer provided on the peelable film may be produced by coating, but is preferably produced by printing. In case of forming a pattern by printing, a gravure printing, a flexo printing, an offset printing or a silk printing method is preferably used. The decorative layer is provided on the peelable film by coating or printing, followed by drying to obtain a film (II).

In the step of laminating the film (I) comprising a curable resin layer provided on the substrate film with the film (II) comprising a decorative layer provided on the peelable film, when lamination is conducted at the temperature higher than 130° C., problems such as shrinking or wrinkling on lamination of the film may occur easily because of poor heat resistance of the substrate film which conventional includes PVA film. Therefore, drying of the film (I) and lamination due to heating under pressure are preferably conducted at a temperature within a range from 40 to 120° C., and more preferably from 40 to 100° C.

In the case of producing a hydraulic transfer film having only a curable resin layer using a dry laminater, the film (I)

comprising a curable resin layer provided on the substrate film is produced in the same manner as in the case of producing the above-mentioned hydraulic transfer film comprising a curable resin layer and a decorative layer. Subsequently, the curable resin layer of the resulting film (I) and the peelable film fed from the second feed roll are laid one upon another, laminated by a heat pressure roll and then taken up by a take-up roll to produce a hydraulic transfer film having only a curable resin layer.

When the resulting hydraulic transfer film of the present invention is stored in a dark place such as a warehouse after being rolled and covering with a light screening paper, the curing reaction does not proceed unnecessarily and blocking of the film does not occur during the storage. Therefore, the hydraulic transfer film enables satisfactory feeding from the roll on hydraulic transfer and enables hydraulic transfer of a clear decorative layer, and also has sufficient marketability as long as it is not exposed to ultraviolet light or sunlight.

The method for producing a formed article comprising a cured resin layer or a decorative layer and a cured resin layer using the hydraulic transfer film of the present invention will now be described.

The method for producing a hydraulic transfer body of the present invention has peeling the peelable film from the hydraulic transfer film of the present invention, floating the hydraulic transfer film on the water surface so that the substrate film faces downward, activating the transfer layer comprising a curable resin layer or a decorative layer and the curable resin layer with an organic solvent, transferring the transfer layer onto a body to be transferred, removing the substrate film, and curing the curable resin layer of the transfer layer by at least one of irradiation with radiation and heating.

After the peelable film is peeled off from the hydraulic transfer film of the present invention, hydraulic transfer can be conducted in the same manner as that of a conventional hydraulic transfer film. The outline of the method for producing a hydraulic transfer body using the hydraulic transfer film is as illustrated below.

(1) After a peelable film is peeled off, a hydraulic transfer film is floated on the water surface in a water tank so that a substrate film faces downward, thereby dissolving or swelling the substrate film in water.
(2) A transfer layer comprising a curable resin layer or the curable resin layer and a decorative layer is activated by applying or spraying an organic solvent over the transfer layer. Activation of the transfer layer due to the organic solvent may be conducted before floating the hydraulic transfer film on the water surface.
(3) While pressing a body to be transferred against the transfer layer, the body to be transferred and the hydraulic transfer film are gradually dipped in water and the transfer layer is transferred by firmly attaching to the body to be transferred by means of hydraulic pressure.
(4) The substrate film is removed from the body to be transferred taken out from water and then the curable resin layer of the transfer layer transferred onto the body to be transferred is cured by at least one of irradiation with radiation and heating to obtain a hydraulic transfer body having a cured resin layer or the cured resin layer and a decorative layer.

It is necessary that the transfer layer comprising a curable resin layer or the curable resin layer and a decorative layer be sufficiently activated with an organic solvent to be sprayed before hydraulic transfer, and then be made sufficiently soluble or flexible. The activation used herein means that the transfer layer is made soluble without completely dissolving a resin constituting the transfer layer by applying or spraying an organic solvent, thereby facilitating peeling of a hydrophobic transfer layer from a hydrophilic substrate film on hydraulic transfer and to impart flexibility to the transfer layer, and thus improving conformability and adhesion of the transfer layer to a three-dimensional curve of the body to be transferred. The activation may be conducted so that the transfer layer is made flexible and can sufficiently conform to the three-dimensional curve of the body to be transferred in the case of transferring the transfer layer onto the body to be transferred from the hydraulic transfer film.

Water in the water tank used in hydraulic transfer not only serves as a hydraulic pressure medium for firmly attaching a curable resin layer or the curable resin layer and a decorative layer of the hydraulic transfer film to the three-dimensional curved surface of a body to be transferred in the case of transferring a transfer layer, but also swells or dissolves a substrate film Specifically, the water may be water such as tap water, distilled water or ion exchanged water, or water containing 10% or less of mineral salts such as boric acid or 50% or less of alcohols dissolved therein according to the kind of the substrate film.

The activating agent used in the present invention is an organic solvent which solubilizes a curable resin layer or the curable resin layer and a decorative layer. The activating agent used in the present invention may be the same as those convensionally used for hydraulic transfer, and specific examples thereof include toluene, xylene, butylcellosolve, butylcarbitol acetate, carbitol, carbitol acetate, cellosolve acetate, methyl isobutyl ketone, ethyl acetate, isobutyl acetate, isobutyl alcohol, isopropyl alcohol, n-butanol, solfit acetate (3-methoxy-3-methyl-1-butylacetate), and mixtures thereof.

To enhance the adhesion between the printing ink or coating composition and the formed article, the activating agent may contain a small amount of a resin component. For example, the adhesion is sometimes enhanced by adding 1 to 10% of a resin having a structure similar to the binder of the ink, such as polyurethane, acrylic resin or epoxy resin.

After transferring the transfer layer onto the body to be transferred, the substrate film is removed by dissolving or peeling in means of water, followed by drying. Similar to a conventional hydraulic transfer method, the substrate film is removed from the body to be transferred by dissolving or peeling off by means of water flow, or removed by peeling.

Regarding curable resin layer containing the radiation-curable resin, the hydraulic transfer body is dried and then the curable resin layer is cured by irradiation with radiation. In the case of the curable resin layer containing the thermosetting resin, drying and curing of the curable resin layer can be simultaneously conducted.

In the present invention, since the curable resin layer is not cured in the transfer step, the curable resin layer of the hydraulic transfer film is easily activated. Furthermore, after transfer, the curable resin layer is cured by at least one of irradiation with radiation and heating and thus sufficient surface protection performances and gloss are achieved.

Preferably, the curable resin layer or decorative layer is firmly attached to the surface of the body to be transferred, and a primer layer is optionally provided on the surface of the body to be transferred. The resin used to form the primer layer may be a conventional resin and examples thereof include, but are not limited to, urethane resin, epoxy resin and acrylic resin. In the case of a body to be transferred made of a resin component having high solvent absorptivity such as ABS resin and SBS rubber each having good adhesion, a primer treatment is not required. The material of the body to be transferred includes, but is not limited to, metal, plastic, lumber, pulp mold or glass as long as it is provided with waterproofness suffient to maintain its shape even when dipped in water by optionally subjecting to a waterproofing treatment.

Specific examples of the hydraulic transfer body, to which the present invention can be applied, include appliances such as TV sets, video recorders, air conditioner, radio cassette tape recorders, cellular phones and refrigerators; office equipment such as personal computers, facsimile mashines and printers; housing sections of domestic products such as hot heaters and cameras; furniture parts, such as tables, chests and pillars; building members such as bathtubs, component kitchens, doors and window frames; general merchandise such as electronic calculators and electronic note books; automobile interior and exterior goods such as automobile interior panels, exterior plates of automobiles and motorcycle, wheel caps, ski carriers and automobile carrier bags; sporting goods such as golf clubs, skis, snowboards, helmets and goggles; and advertising stereoscopic figures, signboards and monuments. The hydraulic transfer of the present invention is particularly suited for use in formed articles, which have a curved surface and also require design properties, and can be used in many fields.

EXAMPLES

The present invention will be described in detail by way of Examples. In the following Examples, "percentages" and "parts" are by mass unless otherwise specified. Methods for the measurement and evaluation used will now be described.

(Method for Measurement of Adhesion Initiation Temperature)

A resin was applied on a 100 μm thick PET film at a thickness (on the basis of solid content) of 10 μm using a bar coater. The coated film was dried at 70° C. for 10 minutes to thereby vaporize the solvent and, after cooling to room temperature, the film was put in a hot-air drier and the temperature was raised from room temperature by 5° C. Then, adhesion was confirmed by touching with fingers at each temperature to determine a minimum temperature at which fingerprints remained as adhesion initiation temperature.

(Evaluation of Take-Up Properties of Hydraulic Transfer Film)

when a hydraulic transfer film was taken up using a take-up unit after production;

Samples where neither wrinkling nor blocking occurred were rated "A".

Samples where slight wrinkling or blocking occurred were rated "B".

Samples where wrinkling or blocking or both of wrinkling and blocking occurred were rated "C".

(Dimensional Stability of Hydraulic Transfer Film)

A curable resin was applied on a PVA film and dried at 60° C., and then laminated with a film (II).

Samples where the width of a film accounts for at least 95% of the width before printing or coating were rated "A".

Samples where the width of a film accounts for less than 95% of the width before printing or coating were rated "C".

(Method for Measurement of Peel Force of Hydraulic Transfer Film)

In accordance with the method described in JIS K6854, a peel force of a hydraulic transfer film (200 mm×25 mm) was measured at a rate of 10 mm/min using a precision power meter, PP-650-D Digital Gauge, PGDII manufactured by Marubishi Kagaku-Kikai Seisakusho Co., Ltd.

(Evaluation of Occurrence of Bocking of Hydraulic Transfer Film after Storage)

A hydraulic transfer film (10 m) was stored in a thermostatic chamber at 20° C. and 60% RH in the state of being taken up in the form of a roll. After three months, the film was pulled out and blocking of the film was evaluated.

Samples where no blocking occurred were rated "A".

Samples where blocking drastically increased a pull-out force of the film were rated "C".

(Method for Measurement of Adhesion of Hydraulic Transfer Body)

Ink adhesion of a hydraulic transfer body transferred hydraulically onto a primer-coated galvanized steel plate (flat plate: 100 mm×100 mm×0.5 mm) or an ABS resin plate (flat plate: 100 mm×100 mm×3 mm) was evaluated by the method defined in a cross-cut adhesive tape method (JIS K5400) on the basis of perfect scores of 10.

(Method for Measurement of Damage of Scratching Resistance of Hydraulic Transfer Body)

In accordance with "pencil scratch tester for coating film" defined in JIS K5401, damage of scratching resistance of a hydraulic transfer body was measured. The length of the core was 3 mm, the angle to the coated surface was 45 degrees, the load was 1 kg, the scratching speed was 0.5 mm/min, the scratching length was 3 mm, and the pencil used was a pencil which is commercially available under the trade name of Mitsubishi Uni.

(Method for Measurement of Surface Gloss of Hydraulic Transfer Body)

60-degree mirror surface gloss (JIS K5400) of a hydraulic transfer body was measured.

(Method for Measurement of Rubbing Resistance of Hydraulic Transfer Body)

Using a hydraulic transfer body transferred hydraulically onto a primer-coated galvanized steel plate (flat plate: 100 mm×100 mm×0.5 mm) or an ABS resin plate (flat plate: 100 mm×100 mm×3 mm), surface gloss retention after dry rubbing 100 times was evaluated by a rubbing tester (load: 800 g).

(Method for Measurement of Adhesion of Hydraulic Transfer Body after Hot Water Treatment)

A hydraulic transfer body was dipped in hot water (temperature: 98° C.) for 30 minutes and then a transfer layer was cut by a cutter to form 100 cross-cuts of 1 mm×1 mm according to the method defined in a cross-cut adhesive tape method (JIS K5400). An adhesive tape was adhered on the surface of the cross-cuts and quickly peeled off, and then the peel condition of the coating film was visually observed and ink adhesion was evaluated on the basis of perfect scores of 10.

(Method for Measurement of Gloss Retention of Hydraulic Transfer Body after Hot Water Treatment)

A hydraulic transfer body was dipped in hot water at 98° C. for 30 minutes and 60° gloss was measured by a gloss meter, and then gloss retention before and after the hot water treatment was calculated.

Preparation Example 1

Preparation of Curable Resin A1

Using 60 parts of an average hexafunctional urethane acrylate (UA1) (mass-average molecular weight: 890) obtained by reacting 2 mol equivalents of pentaerythritol, 7 mol equivalents of hexamethylene diisocyanate and 6 mol equivalents of hydroxyethyl methacrylate at 60° C., 40 parts of an acrylic resin, Paraloid A-11<(Tg: 100° C., mass-average molecular weight: 125,000) manufactured by Rohm & Haas, and a solvent mixture of ethyl acetate and methyl ethyl keton (mixing ratio: 1/1), a curable resin A1 having a solid content of 42% was prepared. A adhesion initiation temperature of the resin component was 50° C.

Preparation Example 2

Preparation of Curable Resin A2

Using 60 parts of Beamset 575 (hexafunctional polyurethane acrylate, mass-average molecular weight: 1,000) manufactured by Arakawa Chemical Industries, Ltd., 10 parts of DPA-720 (ester acrylate, molecular weight: 410) manufactured by DAINIPPON INK & CHEMICALS INC., 40 parts of an acrylic resin, Paraloid B-72 (Tg: 40° C., mass-average molecular weight: 105,000) manufactured by Rohm & Haas and a solvent mixture of ethyl acetate and toluene (mixing ratio: 1/1), a curable resin A2 having a solid content of 45% was prepared. A adhesion initiation temperature of the resin component was 40° C.

Preparation Example 3

Preparation of Curable Resin A3

Using 40 parts of the average hexafunctional urethane acrylate (UA1) of Preparation Example 1, 30 parts of Beamset 575 (hexafunctional polyurethane acrylate) manufactured by Arakawa Chemical Industries, Ltd., 30 parts of VYLON 500 (polyester, Tg: 40° C., mass-average molecular weight: 25,000) manufactured by Toyobo Co., Ltd., and a solvent mixture of ethyl acetate and toluene (mixing ratio: 1:1), a curable resin A3 having a solid content of 50% was prepared. A adhesion initiation temperature of the resin component was 40° C.

Preparation Example 4

Preparation of Curable Resin A4

Using 80 parts of the average hexafunctional urethane acrylate (UA1) of Preparation Example 1, 10 parts of polyethylene glycol diacrylate (mass-average molecular weight: 1,000), 10 parts of ACRYPET VH (acrylic resin, Tg: 90° C., mass-average molecular weight: 205,000) manufactured by Mitsubishi Rayon Co., Ltd., and a solvent mixture of ethyl acetate and toluene (mixing ratio: 1:1), a curable resin A4 having a solid content of 40% was prepared. A adhesion initiation temperature of the resin component was 45° C.

Preparation Example 5

Preparation of Curable Resin A5

100 parts of a polymer (mass-average molecular weight: 25,000) obtained by radical copolymerization of methyl methacrylate, butyl methacrylate and hydroxyethyl methacrylate in a molar ratio of 5:2:3 was dissolved in toluene to obtain a 30% solution and 10 parts of an acryl isocyanate monomer MOI manufactured by Show Denko K.K. was added, followed by stirring at 50° C. for one hour to obtain a curable resin which has a methacryl group in the side chain and also has Tg of 55° C. and a adhesion initiation temperature of 50° C. To this solution, Irgacure 184 manufactured by Ciba-Geigy Limited was added in an amount of 1% based on the solid content to obtain a curable resin A5 having a solid content of 30%.

Preparation Example 6

Preparation of Curable Resin A6

81 Parts of acrylpolyol (a) (mass-average molecular weight: 25,000) obtained by copolymerization of hydroxyethyl methacrylate, methyl methacrylate, ethyl acrylate, butyl acrylate and styrene in a molar ratio of 20:30:15:15:20, and 19 parts of a mixture of a hexamethylene diisocyanate phenol adduct having an isocyanate value in 1.1 equivalents per equivalent of an hydroxyl value of the acrylpolyol and a phenol adduct of a trimer of hexamethylene diisocyanate were disolved in a solvent mixture of toluene and ethyl acetate (1/1) to obtain a curable resin A6 having a solid content of 35%. A adhesion initiation temperature of the solid content of the resin was 40° C.

Preparation Example 7

Preparation of Curable Resin A7

50 Parts of acrylpolyol (b) (mass-average molecular weight: 20,000) obtained by copolymerization of hydroxyethyl methacrylate, methyl methacrylate, ethyl acrylate, butyl acrylate, butyl fumarate and styrene in a molar ratio of 20:30:20:10:10:10, 10 parts of a mixture of a hexamethylene diisocyanate phenol adduct having an isocyanate value in 1.1 equivalents per equivalent of an hydroxyl value of the acrylpolyol and a phenol adduct of a trimer of hexamethylene diisocyanate and 40 parts of dipentaerythritol hexaacrylate were disolved in a solvent mixture of toluene and ethyl acetate (1/1) to obtain a curable resin A7 having a solid content of 35%. A adhesion initiation temperature of the solid content of the resin was 40° C. The compositions of the curable resin layers containing the curable resins A1 to A7 are shown in Table 1 and Table 2.

TABLE 1

| | | Preparation Example 1 A1 | Preparation Example 2 A2 | Preparation Example 3 A3 | Preparation Example 4 A4 |
|---|---|---|---|---|---|
| Curable resin | Component (1) | Urethane acrylate | Urethane acrylate | Urethane acrylate | Urethane acrylate |
| | Molecular weight | 890 | 1,000 | 890 | 890 |
| | Component (2) | None | Ester acrylate | Polyurethane acrylate | Polyethylene glycol diacrylate |

TABLE 1-continued

| | | Preparation Example 1 A1 | Preparation Example 2 A2 | Preparation Example 3 A3 | Preparation Example 4 A4 |
|---|---|---|---|---|---|
| Thermoplastic resin | Component (3) | Acrylic resin | Acrylic resin | Polyester | Acrylic resin |
| | Molecular weight | 125,000 | 105,000 | 25,000 | 205,000 |
| | Tg | 100° C. | 40° C. | 40° C. | 90° C. |
| (1):(2):(3) | | 6:0:4 | 6:1:3 | 4:3:3 | 8:1:1 |
| Polymerization initiator | | Irgacure 184 | Irgacure 819 | Irgacure 184 | Irgacure 184 |
| Adhesion initiation temperature | | 50° C. | 40° C. | 35° C. | 45° C. |

TABLE 2

| | | Preparation Example 5 A5 | Preparation Example 6 A6 | Preparation Example 7 A7 |
|---|---|---|---|---|
| Curable resin | Thermosetting resin (1) | None | Acrylpolyol (a) | Acrylpolyol (b) |
| | Molecular weight | | 25,000 | 20,000 |
| | Curing agent | None | Blocked isocyanate | Blocked isocyanate |
| | Radiation-curable resin (2) | Acrylic resin | None | Dipentahexa acrylate |
| (1):(2) | | — | — | 5:4 |
| Polymerization initiator | | Irgacure 184 | None | Irgacure 184 |
| Adhesion initiation temperature | | 50° C. | 40° C. | 40° C. |

Preparation Example 8

(Production of Decorative Film (II) B1)

Using a 50 μm thick non-oriented polypropylene film (hereinafter abbreviated to a PP film) manufactured by Toyobo Co., Ltd. as a peelable film and an urethane ink (trade name: UNIVURE A), a 3 μm thick grained pattern was formed on the film by a gravure four-color printer to obtain a decorative film (II) B1.

Preparation Example 9

Production of Decorative Film (II) B2)

Using a 50 μm thick oriented polypropylene film (hereinafter abbreviated to an OPP film) manufactured by Toyobo Co., Ltd., as a peelable film and an urethane ink having the following composition, a 4 μm thick abstract pattern was formed on the film by a gravure seven-color printer to obtain a decorative film (II) B2.

(Composition of Ink: Black, Brown and White)

polyurethane (Polyurethane 2569; manufactured by Arakawa Chemical Industries, Ltd.):20 Parts Pigment (black, brown and white): 10 Parts Ethyl acetate/toluene (1/1): 60 Parts Additives such as wax: 10 Parts Example 1

The curable resin A1 of Preparation Example 1 was applied on a 30 μm thick PVA film manufactured by Aicello Chemical Co., Ltd., in a thickness (on the basis of solid content) of 20 μm using a lip coater and then dried at 60° C. for two minutes to obtain a film (I). A curable resin layer of this film (I) was laminated with an OPP film manufactured by Toyobo Co., Ltd., at 60° C. and the resulting laminated film was taken up to obtain a hydraulic transfer film C1.

The OPP film was peeled off from the hydraulic transfer film C1. A peel force between the curable resin layer and the OPP film was sufficiently low such as 25 g/cm, and neither wrinkling nor striations remained in the curable resin layer.

Example 2

The curable resin A1 of Preparation Example 1 was applied on a 30 μm thick PVA film manufactured by Aicello Chemical Co., Ltd., in a thickness (on the basis of solid content) of 20 μm using a lip coater and then dried at 60° C. for two minutes to obtain a film (I). A curable resin layer of this film (I) was laminated with an ink layer (decorative layer) of a decorative film (II) B1 at 60° C. so that these layers face each other and the laminated film was taken up to obtain a hydraulic transfer film C2.

When the PP film was peeled off from the hydraulic transfer film C2, the ink layer (decorative layer) was transferred to the side of the PVA film without causing any defects. A peel force between the PP film and the decorative layer was sufficiently low such as 5 g/cm, and neither wrinkling nor striation remained in the curable resin layer.

In Examples 3 to 7, hydraulic transfer films having a decorative layer were produced in almost the same manner as in Example 2. The results are shown in Table 3 and Table 4. In all examples, a hydraulic transfer film having a decorative layer and a curable resin layer was obtained. By peeling off the PP or OPP film, the decorative layer was completely transferred to the side of the PVA film.

TABLE 3

| | | Example 1 | Example 2 | Example 3 | Example 4 |
|---|---|---|---|---|---|
| Decorative Layer | Decorative film (II) | — | B1 | B2 | B1 |
| | Peelable film | OPP | PP | OPP | PP |
| | Pattern | — | Grained pattern | Abstract pattern | Grained pattern |

TABLE 3-continued

| | | Example 1 | Example 2 | Example 3 | Example 4 |
|---|---|---|---|---|---|
| Hydraulic transfer film | Curable resin | A1 | A1 | A2 | A3 |
| | Substrate film | PVA | PVA | PVA | PVA |
| | Thickness of curable resin layer | 20 μm | 20 μm | 30 μm | 20 μm |
| | Drying temperature | 60° C., 2 min. | 60° C., 2 min. | 60° C., 3 min. | 60° C., 2 min. |
| | Lamination | 60° C. | 60° C. | 50° C. | 40° C. |
| | Temperature, Pressure | 0.4 MPa | 0.4 MPa | 0.4 MPa | 0.4 MPa |
| | Hydraulic transfer film | C1 | C2 | C3 | C4 |
| | Take-up properties | A | A | A | A |
| | Dimensional stability of film | — | A | A | A |
| | Peel force (g/cm) | 25 | 5 | 43 | 10 |
| | Occurrence of blocking | A | A | A | A |
| | Peelability | A | A | A | A |

TABLE 4

| | | Example 5 | Example 6 | Example 7 |
|---|---|---|---|---|
| Decorative Layer | Decorative film (II) | B1 | B1 | B1 |
| | Peelable film | PP | PP | PP |
| | Pattern | Grained pattern | Grained pattern | Grained pattern |
| Hydraulic transfer film | Curable resin | A4 | A6 | A7 |
| | Substrate film | PVA | PVA | PVA |
| | Thickness of curable resin layer | 10 μm | 20 μm | 15 μm |
| | Drying temperature | 60° C., 1 min. | 60° C., 2 min. | 60° C., 2 min. |
| | Lamination | 40° C. | 50° C. | 40° C. |
| | Temperature, Pressure | 0.4 MPa | 0.4 MPa | 0.4 MPa |
| | Hydraulic transfer film | C5 | C6 | C7 |
| | Take-up properties | A | A | A |
| | Dimensional stability of film | A | A | A |
| | Peel force (g/cm) | 3 | 36 | 25 |
| | Occurrence of blocking | A | A | A |
| | Peelability | A | A | A |

Example 8

Hydraulic Transfer

After charging hot water at 30° C. in a water tank, the OPP film of the hydraulic transfer film C1 was peeled off and the hydraulic transfer film C1 was floated on the water surface so that the ink layer (decorative layer) faces upward. After spraying an activating agent (xylene:MIBK:butyl acetate:isopropanol=5:2:2:1) with a weight of 40 g/m$^2$, an A4 size primer-coated steel plate was inserted into the water surface from the ink surface, thereby performing hydraulic transfer. After drying at 120° C. for 30 minutes, a curable resin phase was completely cured by irradiating twice with ultraviolet light at a dose of 200 mJ/cm$^2$. As a result, a decorative hydraulic transfer body having a cured resin layer with excellent surface gloss was obtained. In the same manner as in Example 8, hydraulic transfer was conducted in Examples 9 to 12. The results are shown in Table 5 and Table 6.

Example 13

Hydraulic Transfer

After charging hot water at 30° C. in a water tank, the PP film of the hydraulic transfer film C6 was peeled off and the hydraulic transfer film C6 was floated on the water surface so that the ink layer (decorative layer) faces upward. After spraying an activating agent (xylene:MIBK:butyl acetate:isopropanol=5:2:2:1) with 40 g/m$^2$, a refrigerator door made of a primer-coated steel plate was inserted into the water surface from the ink surface, thereby performing hydraulic transfer. Drying of the activating agent and curing of the thermosetting resin layer were conducted by heating at 120° C. for 30 minutes. As a result, a decorative hydraulic transfer body having a cured resin layer with excellent surface gloss and a printed layer was obtained.

Example 14

Hydraulic Transfer

After charging hot water at 30° C. in a water tank, the PP film of the hydraulic transfer film C7 was peeled off and the hydraulic transfer film C7 was floated on the water surface so that the ink layer (decorative layer) faced upward. After spraying an activating agent (xylene:MIBK:butyl acetate:isopropanol=5:2:2:1) with 40 g/m$^2$, an oil fan heater housing made of a primer-coated steel plate was inserted into the water surface from the ink surface, thereby performing hydraulic transfer. Drying of the activating agent and curing of the thermosetting resin layer were conducted by heating at 120° C. for 30 minutes. Then, an ultraviolet-curable resin was completely cured by irradiating twice with ultraviolet light at a dose of 200 mJ/cm$^2$. As a result, a decorative hydraulic transfer body having a cured resin layer with excellent surface gloss and a printed layer was obtained.

As is apparent from the results of this example, by using a curable resin having a adhesion initiation temperature of 120° C. or less, coating onto the PVA film and lamination of the printed film can be conducted with ease and a decorative hydraulic transfer body having excellent gloss can be obtained from the resulting hydraulic transfer film.

TABLE 5

| | | Example 8 | Example 9 | Example 10 | Example 11 |
|---|---|---|---|---|---|
| Hydraulic transfer | Hydraulic transfer film | C1 | C2 | C3 | C4 |
| | Water Temperature on transfer | 30° C. | 30° C. | 25° C. | 25° C. |
| | Activating agent (g/m$^2$) | 40 | 40 | 40 | 48 |
| | Body to be transferred to | Primer-coated steel plate | Primer-coated steel plate | ABS door handle | Fan heater housing made of steel plate |
| Post-treatment | Ultraviolet dose (mJ/cm$^2$) | 400 | 400 | 400 | 400 |
| | Drying temperature | 120° C. | 120° C. | 70° C. | 120° C. |
| | Time | 30 min | 30 min | 30 min | 30 min |
| Hydraulic transfer body | Adhesion | 10 | 10 | 10 | 10 |
| | Scratch resistance | 2H | 2H | F | H |
| | Surface gloss (%) | 91 | 89 | 93 | 89 |
| | Rubbing resistance (%) | 92 | 92 | 90 | 91 |
| | Adhesion after hot water treatment | 10 | 10 | 10 | 10 |
| | Gloss retention after hot water treatment (%) | 98 | 98 | 95 | 97 |

TABLE 6

| | | Example 12 | Example 13 | Example 14 |
|---|---|---|---|---|
| Hydraulic transfer | Hydraulic transfer film | C5 | C6 | C7 |
| | Water Temperature on transfer | 30° C. | 30° C. | 30° C. |
| | Activating agent (g/m$^2$) | 40 | 40 | 48 |
| | Body to be transferred to | ABS panel | Refrigerator door made of steel plate | Oil fan heater housing made of steel plate |
| Post-treatment | Ultraviolet dose (mJ/cm$^2$) | 400 | None | 400 |
| | Drying temperature | 60° C. | 120° C. | 120° C. |
| | Time | 30 min. | 60 min. | 30 min. |
| Hydraulic transfer body | Adhesion | 10 | 10 | 10 |
| | Scratch resistance | H | H | H |
| | Surface gloss (%) | 96 | 89 | 90 |
| | Rubbing resistance (%) | 89 | 85 | 85 |
| | Adhesion after hot water treatment | 10 | 10 | 10 |
| | Gloss retention after hot water treatment (%) | 95 | 95 | 94 |

Comparative Example 1

Production of Hydraulic Transfer Film with No Peelable Film

A curable resin A2 was applied-on a 30 μm PVA film manufactured by Aicello Chemical Co., Ltd., in a thickness (on the basis of solid content) of 20 μm using a lip coater. After drying at 60° C. for two minutes, the film was taken up without being laminated with a peelable film. As a result, hydraulic transfer could not be performed because of blocking of the film.

Comparative Example 2

Production of Hydraulic Transfer Film with No Peelable Film

A curable resin A6 was applied on a 30 μm PVA film manufactured by Aicello Chemical Co., Ltd. in a thickness (on the basis of solid content) of 20 μm using a lip coater. After drying at 60° C. for two minutes, the resulting film (I) was taken up. This film was stored at a temperature of 20° C. and a humidity of 60% for one month without being laminated with a peelable film. As a result, blocking of the cured resin layer and the PVA film occurred and the cured resin layer was peeled off from the PVA film when the film is pulled out.

Comparative Example 3

Production of Hydraulic Transfer Film with Ultraviolet-Curable Resin Layer

A curable resin A2 was applied on a 30 μm PVA film manufactured by Aicello Chemical Co., Ltd., in a thickness (on the basis of solid content) of 20 μm using a lip coater. After drying at 60° C. for two minutes, the resulting film (I) was produced. A trial of forming a printed layer on the curable resin layer of the film (I) by gravure printing was made. However, printing could not be conducted because of blocking of the taken-up film.

As shown in the Comparative Examples, the hydraulic transfer films having a curable resin layer with no peelable film was inferior in take-up properties and the decorative layer was printed with difficulty, or blocking occurred when the taken-up film was stored for one month. In contrary, as shown in Examples, the hydraulic transfer film of the present invention was excellent in take-up properties and feeding properties of the film and no blocking occurred even when stored for three or more months in the state of being rolled, and also the peelable film was peeled off with ease. The hydraulic transfer body obtained by transferring a curable resin layer or the curable resin layer and a decorative layer using the hydraulic transfer film of the present invention was excellent in surface gloss, rubbing resistance, and adhesion and gloss after the hot water treatment.

INDUSTRIAL APPLICABILITY

The hydraulic transfer film of the present invention has excellent roll take-up properties and storage stability because it is made possible to prevent blocking between the curable resin layer or the decorative layer and the substrate film by providing the peelable film on the curable resin layer or the decorative layer.

According to the method for producing a hydraulic transfer film of the present invention, the curable resin layer formed on the substrate film is laminated with the decorative layer formed on the peelable film by dry lamination and thus a clear decorative layer can be formed on the curable resin layer.

Furthermore, according to the method for producing a hydraulic transfer body of the present invention, a hydraulic transfer film which has excellent feeding properties and is free from the occurrence of poor transfer is used and thus a hydraulic transfer body having a cured resin layer with excellent surface properties and a clear pattern can be produced.

The hydraulic transfer film of the present invention makes it possible to produce a hydraulic transfer body having excellent surface properties such as solvent resistance, chemical resistance and surface hardness as well as design properties, and is particularly useful in the production of decorated hydraulic transfer bodies which require design properties and surface strength, for example, appliances, building members, and automobile members.

The invention claimed is:

1. A hydraulic transfer film comprising:

a substrate film containing a water-soluble or water-swellable resin;

a transfer layer which is hydrophobic and soluble in an organic solvent provided on the substrate film; and a peelable film which can be peeled off at the interface with the transfer layer provided on the transfer layer, wherein the transfer layer contains a curable resin layer which contains a curable resin selected from the group consisting of a radiation-curable resin having at least three (meth) acryloyl groups in a molecule, and a thermosetting resin containing blocked isocyanate and polyol; and also contains a non-polymerizable thermoplastic resin having a glass transition temperature of 35 to 200° C. which is compatible with the curable resin.

2. The hydraulic transfer film according to claim 1, wherein the transfer layer comprises the curable resin layer provided on the substrate film and a decorative layer having a printing ink film or a coating film provided on the curable resin layer.

3. The hydraulic transfer film according to claim 1 or 2, which is produced by laying a film (I) comprising the curable resin layer which is curable by at least one of irradiation with radiation and heating and is soluble in an organic solvent provided on the substrate film containing a water-soluble or water-swellable resin, and a film (II) comprising a decorative layer made of a printing ink film or a coating film which is hydrophobic and soluble in an organic solvent provided on the peelable film one upon another so that the curable resin layer of the film (I) and the decorative layer of the film (II) face each other, and laminating them by dry lamination.

4. The hydraulic transfer film according to claim 3, wherein the film (I) comprising the curable resin layer is provided on the substrate film, which is made of polyvinyl alcohol, and the temperature on heat lamination with the film (II), comprising the decorative layer provided on the peelable film, is from 40 to 120° C.

5. The hydraulic transfer film according to claim 1, wherein an adhesion initiation temperature of the curable resin layer is 40° C. or higher and 120° C. or lower.

6. The hydraulic transfer film according to claim 5, wherein the curable resin layer contains a radiation-curable resin having a mass-average molecular weight of 300 to 10,000 and having at least three (meth)acryloyl groups in a molecule, and a non-polymerizable thermoplastic resin having a mass-average molecular weight of 10,000 to 400,000 and Tg of 35 to 200° C.

7. The hydraulic transfer film according to claim 5, wherein the curable resin layer contains a radiation-curable resin selected from the group consisting of(1) polyurethane (meth) acrylate having at least three (meth)acryloyl groups in a molecule, (2) polyester (meth)acrylate having at least three (meth)acryloyl groups in a molecule, and (3) epoxy (meth) acrylate having at least three (meth)acryloyl groups in a molecule and the non-polymerizable thermoplastic resin which is polymethacrylate.

8. The hydraulic transfer film according to claim 1, wherein the curable resin layer contains polyol having a mass-average molecular weight of 3,000 to 100,000 as a base agent and blocked isocyanate as a curing agent.

* * * * *